US011066888B2

(12) United States Patent
Creighton

(10) Patent No.: US 11,066,888 B2
(45) Date of Patent: Jul. 20, 2021

(54) METHOD AND SYSTEM FOR PERFORMING WELL OPERATIONS

(71) Applicant: Paradigm Technology Services B.V., LG Groot-Ammers (NL)

(72) Inventor: John Leith Creighton, Aberdeen (GB)

(73) Assignee: Paradigm Technology Services B.V., Groot-Ammers (NL)

( * ) Notice: Subject to any disclaimer, the term of this patent is extended or adjusted under 35 U.S.C. 154(b) by 161 days.

(21) Appl. No.: 15/747,887

(22) PCT Filed: Jul. 25, 2016

(86) PCT No.: PCT/EP2016/067695
§ 371 (c)(1),
(2) Date: Jan. 26, 2018

(87) PCT Pub. No.: WO2017/017070
PCT Pub. Date: Feb. 2, 2017

(65) Prior Publication Data

US 2018/0209235 A1 Jul. 26, 2018

(30) Foreign Application Priority Data

Jul. 28, 2015 (GB) ..... 1513297

(51) Int. Cl.
*E21B 33/035* (2006.01)
*E21B 44/00* (2006.01)
(Continued)

(52) U.S. Cl.
CPC ..... *E21B 33/0355* (2013.01); *E21B 44/00* (2013.01); *E21B 47/092* (2020.05); *E21B 47/13* (2020.05); *E21B 47/135* (2020.05)

(58) Field of Classification Search
CPC .. E21B 33/0355; E21B 44/00; E21B 47/0905; E21B 47/122; E21B 47/123
See application file for complete search history.

(56) References Cited

U.S. PATENT DOCUMENTS 3,978,588 A 9/1976 Richardson et al.
4,023,092 A * 5/1977 Rogers ..... E21B 31/00 324/221
(Continued)

FOREIGN PATENT DOCUMENTS

EP 0959225 A2 11/1999
GB 2306657 A 5/1997
(Continued)

OTHER PUBLICATIONS

International Search Report; GB1513297.0; dated Nov. 4, 2015; 2 pages.
(Continued)

*Primary Examiner* — Daniel P Stephenson
(74) *Attorney, Agent, or Firm* — William H. Honaker; Dickinson Wright PLLC

(57) ABSTRACT

A method for performing operations in a well comprises sensing a condition at, adjacent, or within a wellhead arrangement located at an opening of the well and performing a safety procedure in response to the sensed condition to improve the safety of the well operations. The method may comprise sensing the condition when a tool is located at, adjacent to, or within the wellhead arrangement. The sensed condition may be associated with a status of the tool. The sensed condition may be associated with an emission, field or signal transmitted to and/or from the tool, extending to and/or from the tool, and/or coupled to and/or from the tool. Performing the safety procedure may comprise controlling a position or status of the tool or controlling an environment at, adjacent to, or within the wellhead arrangement.

22 Claims, 4 Drawing Sheets

(51) Int. Cl.

| | |
|---|---|
| ***E21B 47/09*** | (2012.01) |
| ***E21B 47/12*** | (2012.01) |
| ***E21B 47/13*** | (2012.01) |
| ***E21B 47/092*** | (2012.01) |
| ***E21B 47/135*** | (2012.01) |

(56) References Cited

U.S. PATENT DOCUMENTS

| | | | | |
|---|---|---|---|---|
| 4,940,095 | A * | 7/1990 | Newman | E21B 19/22 166/378 |
| 7,819,189 | B1 * | 10/2010 | Cosby | E21B 47/09 166/250.01 |
| 9,181,793 | B2 * | 11/2015 | Baxter | E21B 44/00 |
| 10,323,508 | B2 * | 6/2019 | Coles | E21B 41/0021 |
| 10,487,641 | B2 * | 11/2019 | Zheng | H04W 4/00 |
| 10,570,689 | B2 * | 2/2020 | Jaffrey | E21B 33/06 |
| 2002/0093431 | A1 * | 7/2002 | Zierolf | E21B 17/006 340/854.1 |
| 2003/0043055 | A1 * | 3/2003 | Schultz | E21B 41/0085 340/856.3 |
| 2004/0011533 | A1 * | 1/2004 | Lawrence | E21B 23/01 166/382 |
| 2007/0051512 | A1 | 3/2007 | Markel | |
| 2009/0121895 | A1 * | 5/2009 | Denny | E21B 17/006 340/854.1 |
| 2009/0327102 | A1 * | 12/2009 | Maniar | G06Q 10/08 705/28 |
| 2010/0245075 | A1 * | 9/2010 | Stevens | G06Q 10/08 340/539.1 |
| 2012/0092134 | A1 * | 4/2012 | Stern | G01S 13/75 340/10.1 |
| 2012/0223813 | A1 | 9/2012 | Baxter | |
| 2016/0003033 | A1 * | 1/2016 | Coles | E21B 41/0021 73/152.58 |
| 2018/0209235 | A1 * | 7/2018 | Creighton | E21B 33/0355 |
| 2020/0063553 | A1 * | 2/2020 | Zemla | E21B 23/10 |

FOREIGN PATENT DOCUMENTS

| | | | |
|---|---|---|---|
| WO | 2014133504 | A1 | 9/2014 |
| WO | 2014135861 | A2 | 9/2014 |

OTHER PUBLICATIONS

International Search Report, PCT/EP2016/067695; dated Sep. 27, 2016; 3 pages.

* cited by examiner

METHOD AND SYSTEM FOR PERFORMING WELL OPERATIONS

CROSS-REFERENCE TO RELATED APPLICATION

The present invention claims priority to PCT International Patent Application Serial No. PCT/EP2016/067695 filed Jul. 25, 2016 entitled "Method and System for Performing Well Operations," which claims the benefit of GB Patent Application Serial No. 1513297.0 filed Jul. 25, 2015, the entire disclosures of the applications being considered part of the disclosure of this application and hereby incorporated by reference.

FIELD

The present invention relates to a method and a system for performing well operations and in particular, though not exclusively, for performing well operations in an oil or gas well.

BACKGROUND

It is known to use downhole tools to perform various operations in oil and gas wells. For example, it is known to run battery powered tools into oil or gas wells on wireline or slickline. Such tools are generally pre-programmed prior to deployment into a well so as to begin and finish performing an operation at specific times. The use of such tools may, however, restrict the flexibility to change or abort downhole operations. In the worst case, the use of such downhole tools may even compromise the safety of downhole operations.

SUMMARY

One or more of the features of any one of the following aspects may apply alone or in any combination in relation to any of the other aspects.

According to an aspect of the present invention there is provided a method for performing operations in a well, comprising:

sensing a condition at, adjacent, or within a wellhead arrangement located at an opening of the well; and performing a safety procedure in response to the sensed condition to improve the safety of the well operations.

As a consequence of performing the safety procedure, the probability of an operator being exposed to a harmful emission, field or signal may be reduced. As a consequence of performing one or more of these safety procedures, the probability of a prohibited emission, field or signal being emitted in a zone surrounding the wellhead arrangement may be reduced.

As a consequence of performing the safety procedure, the probability of leakage of an explosive, flammable or noxious fluid from the wellhead arrangement may be reduced.

The method may comprise sensing the condition when a tool is located at, adjacent to, or within the wellhead arrangement.

The tool may comprise a logging tool.

The tool may comprise a perforating gun.

The method may comprise sensing the condition during recovery of the tool from the well.

The method may comprise sensing the condition as the tool is recovered into a wellhead arrangement.

The method may comprise sensing the condition when the tool is located within the wellhead arrangement.

The method may comprise sensing the condition when the tool is located at or adjacent to a lubricator.

The method may comprise sensing the condition as the tool is recovered into the lubricator.

The method may comprise sensing the condition when the tool is located within the lubricator.

The method may comprise attaching a line to the tool and paying out and/or hauling in the line so as to control the position of the tool in the well.

The method may comprise paying out the line for deployment of the tool in the well.

The method may comprise hauling in the line for recovery of the tool from the well.

The method may comprise hauling in the line so as to pull the tool into the wellhead arrangement.

The method may comprise sensing the condition as the tool is pulled into the wellhead arrangement by the line.

The method may comprise hauling in the line so as to pull the tool into the lubricator.

The method may comprise sensing the condition as the tool is pulled into the lubricator by the line.

The line may be capable of transmitting a signal. The line may be capable of transmitting an electromagnetic signal. The line may be capable of transmitting an electric signal. The line may comprise an electrical conductor. The line may be capable of transmitting an optical signal. The line may comprise an optical fibre. The line may comprise at least one of a slickline, a wireline, a wire, a cable and a rope. The line may comprise a braided wireline or a conductor wireline. The line may comprise at least one of a composite slickline, a coated slickline and an insulated slickline.

The method may comprise communicating with the tool via the line.

Sensing the condition may comprise reading or receiving information from the tool via the line.

The method may comprise communicating wirelessly with the tool.

The sensed condition may be associated with a status of the tool.

The sensed condition may be associated with an emission, field or signal transmitted to and/or from the tool, extending to and/or from the tool, and/or coupled to and/or from the tool.

The sensed condition may be associated with a level, magnitude, amplitude or strength of an emission, field or signal transmitted to and/or from the tool, extending to and/or from the tool, or coupled to and/or from the tool.

The sensed condition may be associated with radioactivity. The sensed condition may be associated with a neutron pulse. The sensed condition may be associated with gamma radiation and/or gamma rays.

The sensed condition may be associated with an electromagnetic field. The sensed condition may be associated with an electric field and/or a magnetic field. The sensed condition may be associated with an electromagnetic flux. The sensed condition may be associated with an electric flux and/or a magnetic flux. The sensed condition may be associated with a RF electromagnetic field and/or a RF electromagnetic signal. The sensed condition may be associated with an optical field and/or an optical signal.

The sensed condition may be associated with an acoustic signal.

Sensing the condition may comprise reading or receiving information from the tool.

The sensed condition may be associated with, or may be, a temperature of the tool.

The sensed condition may be associated with, or may be, a local temperature of a part, portion or sub of the tool.

The sensed condition may associated with, or may be, a temperature of an exterior of the tool. The wellhead arrangement may comprise a temperature sensor which is configured to provide a signal or an indication representative of the temperature of the exterior of the tool. Sensing the condition may comprise receiving the temperature of the exterior of the tool from the temperature sensor.

The sensed condition may be associated with, or may be, a temperature of an interior of the tool. The tool may comprise a temperature sensor which is configured to provide a signal or an indication representative of the temperature of the interior of the tool. Sensing the condition may comprise receiving the temperature of the interior of the tool from the temperature sensor.

The sensed condition may be associated with, or may be, a pressure of an interior of the tool. The tool may comprise a pressure sensor which is configured to provide a signal or an indication representative of the pressure of the interior of the tool. Sensing the condition may comprise receiving the pressure of the interior of the tool from the pressure sensor.

Sensing the condition may comprise reading or receiving tool status information from the tool.

Sensing the condition may comprise reading or receiving tool identification information from the tool.

The method may comprise reading or receiving tool sensor information from the tool.

The method may comprise sensing the proximity of the tool to the opening of the well.

The method may comprise sensing the proximity of the tool to the wellhead arrangement.

Performing the safety procedure may comprise controlling the tool.

Performing the safety procedure may comprise controlling a position of the tool.

Performing the safety procedure may comprise controlling a winch so as to pay out and/or haul in a line attached to the tool.

Performing the safety procedure may comprise moving the tool through a predetermined series of one or more movements.

Performing the safety procedure may comprise arresting movement of the tool.

Performing the safety procedure may comprise lowering the tool to a predetermined position within the well.

Performing the safety procedure may comprise controlling the condition of the tool.

Performing the safety procedure may comprise changing a status of tool.

Performing the safety procedure may comprise switching off, disabling and/or isolating the tool.

Performing the safety procedure may comprise switching off, cutting or reducing an emission, field or signal transmitted to and/or from the tool, extending to and/or from the tool, and/or coupled to and/or from the tool.

Performing the safety procedure may comprise providing, raising or issuing an alarm.

The alarm may be provided, raised or issued from a user interface or a mobile or personal receiver device.

The alarm may be provided, raised or issued using a vibration, a sound and/or a visual signal.

Performing the safety procedure may comprise sealing the well.

Performing the safety procedure may comprise shearing the tool and/or a line from which the tool is suspended.

The method may comprise providing an RFID tag with the tool, mounting an RFID tag on the tool and/or attaching an RFID tag to the tool.

The method may comprise storing the tool status information, the tool identification information or the tool sensor information in the RFID tag.

The method may comprise locating an RFID reader at, adjacent to, or within, the wellhead arrangement, mounting an RFID reader on the wellhead arrangement and/or attaching an RFID reader to the wellhead arrangement.

The method may comprise locating an RFID reader at, adjacent to, or within a lubricator, mounting an RFID reader on a lubricator and/or attaching an RFID reader to a lubricator.

The method may comprise using the RFID reader to read the information stored in the RFID tag.

The method may comprise providing an RFID tag with each tool of a plurality of tools, mounting an RFID tag on each tool of a plurality of tools, and/or attaching an RFID tag to each tool of a plurality of tools.

The plurality of tools may be coupled together to form a tool string. Each tool may comprise or may be a tool sub.

The method may comprise using the RFID reader to read information stored in each RFID tag.

Sensing the condition may comprise using the RFID reader to read the information stored in the RFID tag.

The sensed condition may be associated with a composition and/or concentration of a fluid within the wellhead arrangement or of a fluid emitted from the wellhead arrangement.

The sensed condition may be associated with a composition and/or concentration of a fluid detected at the wellhead arrangement, within the wellhead arrangement, or leaking from the wellhead arrangement.

The sensed condition may comprise a composition and/or concentration of a hydrocarbon fluid.

The sensed condition may comprise a composition and/or concentration of a gas.

The sensed condition may comprise a composition and/or concentration of a hydrocarbon gas.

The sensed condition may comprise a composition and/or concentration of hydrogen sulphide and/or carbon dioxide.

The sensed condition may be associated with a pressure of a fluid at, adjacent or within the wellhead arrangement.

The sensed condition may be associated with a temperature of a fluid at, adjacent or within the wellhead arrangement.

Performing the safety procedure may comprise controlling an environment at, adjacent or within the wellhead arrangement.

Performing the safety procedure may comprise controlling a pressure and/or a temperature within the wellhead arrangement.

Performing the safety procedure may comprise controlling a stuffing box pressure so as to contain fluid in the wellhead arrangement or so as to at least reduce leakage of fluid from the wellhead arrangement.

Performing the safety procedure may comprise controlling a stuffing box pressure so as to contain fluid in a lubricator or so as to at least reduce leakage of fluid from a lubricator.

The well may comprise a borehole or a wellbore.

The well may be openhole or may comprise an openhole section.

The well may be lined or cased or the well may comprise a liner or a casing.

According to an aspect of the present invention there is provided a system for performing operations in a well, wherein the well comprises a wellhead arrangement located at an opening of the well and the system comprises:

a sensor for sensing a condition at, adjacent, or within the wellhead arrangement;

well equipment; and a controller configured for communication with the sensor and the well equipment, wherein the controller is configured to control the well equipment so as to perform a safety procedure in response to the sensed condition to improve the safety of the well operations.

The well equipment may comprise a tool.

Performing the safety procedure may comprise controlling the tool.

Performing the safety procedure comprises at least one of controlling a condition of the tool, controlling a status of the tool, switching off the tool, disabling the tool, isolating the tool, switching off or cutting an emission, field or signal transmitted to and/or from the tool, extending to and/or from the tool, and/or coupled to and/or from the tool.

Performing the safety procedure may comprise controlling a position of the tool.

The well equipment may comprise a winch for paying out and/or hauling in a line attached to the tool so as to deploy the tool into the well and/or recover the tool from the well.

Performing the safety procedure may comprise controlling the winch so as to pay out and/or haul in the line.

Performing the safety procedure may comprise moving the tool through a predetermined series of one or more movements.

Performing the safety procedure may comprise arresting movement of the tool.

Performing the safety procedure may comprise lowering the tool to a predetermined position within the well.

The system may comprise a user interface.

Performing the safety procedure may comprise using the interface to provide, raise or issue an alarm.

The well equipment may comprise a blowout preventor (BOP).

Performing the safety procedure may comprise using the BOP to seal the well.

The well equipment may comprise Pressure Control Equipment (PCE). The PCE may be configured for controlling stuffing box pressure to eliminate or at least reduce leakage of fluid from the wellhead.

Performing the safety procedure may comprise using the PCE to control the stuffing box pressure.

According to an aspect of the present invention there is provided a method for use in well operations, comprising:

providing a tool with an RFID tag;

storing tool information in the RFID tag; and using an RFID tag reader provided at, adjacent to, or within a wellhead arrangement at an opening of a well to read the stored tool information from the RFID tag.

The tool information may comprise at least one of a tool identifier code, a tool status and tool sensor data.

The method may comprise reading the stored tool information from the RFID tag as the as the tool is recovered from the well past the RFID tag reader.

The method may comprise reading the stored tool information from the RFID tag as the tool is deployed into the well past the RFID tag reader.

The method may comprise performing a safety procedure in response to the stored tool information read from the RFID tag.

Performing the safety procedure may comprise controlling a position or status of the tool.

Performing the safety procedure may comprise controlling an environment at, adjacent to, or within the wellhead arrangement.

The method may comprise:

providing each tool of a plurality of tools with an RFID tag;

storing tool information in each RFID tag; and using an RFID tag reader provided at, adjacent to, or within a wellhead arrangement at an opening of a well to read the stored tool information from each RFID tag.

The method may comprise performing a safety procedure in response to the stored tool information read from one or more of the RFID tags.

BRIEF DESCRIPTION OF THE DRAWINGS

A system and method for performing well operations will now be described by way of non-limiting example only with reference to the following drawings of which.

DETAILED DESCRIPTION OF THE DRAWINGS

Figure 1:
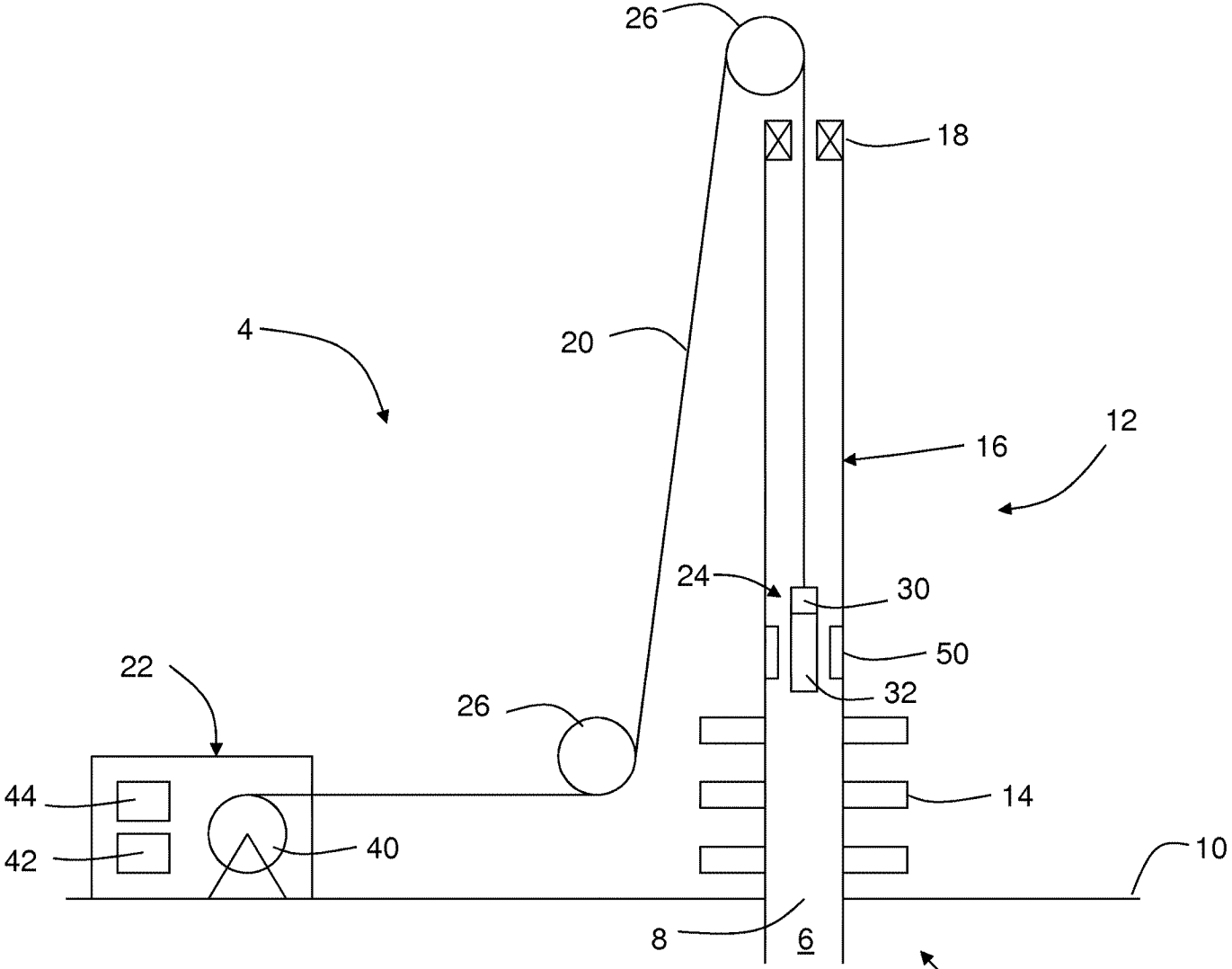
FIG. 1 is a schematic of an oil or gas well and a first system for performing operations in the well.

Referring initially to FIG. 1 there is shown an oil or gas well generally designated 2 and a first system 4 for performing operations in the well 2. The well 2 comprises a wellbore 6 extending from a surface 8. One of ordinary skill in the art will understand that the surface 8 may represent a surface of the ground or the seabed. As shown in FIG. 1, the surface 8 defines an opening 10. A wellhead arrangement generally designated 12 is mounted above the opening 10. The wellhead arrangement 12 comprises a blowout preventer 14 (BOP), a lubricator 16 and a stuffing box 18.

The system 4 comprises a line in the form of a composite slickline 20, a slickline unit 22 at one end of the slickline 20 and a downhole tool 24 attached to the other end of the slickline 20. The system 4 further comprises sheaves 26. The slickline 20 runs from the slickline unit 22 around the sheaves 26 and through the stuffing box 18 that the tool 24 is suspended within the lubricator 16. The stuffing box 18 serves to seal the interior of the lubricator 16 from the environment which surrounds the wellhead arrangement 12 whilst also permitting the slickline 20 to run through the stuffing box 18.

The tool 24 comprises a rope socket 30 for attaching the tool 24 to the slickline 20 and a tool sub 32 for performing measurements of an environment in the wellbore 6 and/or of a subterranean formation surrounding the wellbore 6. For example, the tool sub 32 may comprise a neutron pulse source.

The slickline unit 22 comprises a winch 40 for paying out and/or hauling in the slickline 20, a controller 42 and a user interface 44 configured to permit an operator to manually control well operations and/or configured convey information relating to the well operations to the operator. The user interface 44 may comprise a work station or may comprise a mobile or personal receiver device which may be carried by an operator.

The composite slickline 20 comprises at least one electrical conductor surrounded by at least one electrically insulating layer. The composite slickline 20 is electrically, magnetically and/or electromagnetically coupled with the controller 42 and the tool sub 32. The controller 42 and the tool sub 32 are configured for communication therebetween using an electrical or an electromagnetic signal transmitted along the slickline 20.

The system 4 further comprises one or more sensors for sensing a condition associated with the tool 24. For example, the system 4 of FIG. 1 further comprises a neutron pulse sensor 50 within the lubricator 16 for detecting neutron pulses emitted by the tool sub 32. The neutron pulse sensor 50 is configured for communication with the controller 42.

In use, the winch 40 pays out the slickline 20 so as to deploy the tool 24 from the lubricator 16 through the BOP 14 into the wellbore 6. The tool sub 32 performs measurements of the subterranean formation surrounding the wellbore 6 as the tool 24 moves along the wellbore 6. Logging data measured by the tool sub 32 may be stored in a memory of the tool sub 32 and/or may be transmitted to the controller 42 via the slickline 20.

When well logging operations are complete, the winch 40 hauls in the slickline 20 so as to recover the tool 24 from the wellbore 6 through the BOP 14 into the lubricator 16 under the control of the controller 42. In response to detection of a neutron pulse by the neutron pulse sensor 50, the controller 42 automatically controls the winch 40 so as to perform a safety procedure. More specifically, on detection of a neutron pulse by the neutron pulse sensor 50, the controller 42 reverses the direction of rotation of the winch 40 so as to pay out the slickline 20 again until the tool 24 reaches a predetermined safe depth within the wellbore 6 which is selected to reduce neutron pulse emissions above the surface 10 to a safe level.

Additionally or alternatively, on detection of a neutron pulse by the neutron pulse sensor 50, the controller 42 transmits an electrical and/or electromagnetic signal to the tool sub 32 via the slickline 20 causing the tool sub 32 to cease emitting neutron pulses.

Additionally or alternatively, on detection of a neutron pulse by the neutron pulse sensor 50, the controller 42 communicates with the user interface 44 causing the user interface 44 to provide, raise or issue an alarm for the attention of an operator using vibration, sound and/or a visual signal.

As a consequence of performing one or more of these safety procedures, the probability of an operator being exposed to a harmful level of neutron pulse radiation may be reduced. As a consequence of performing one or more of these safety procedures, the probability of a prohibited level of neutron pulse radiation being emitted in a zone surrounding the wellhead arrangement 12 may be reduced.

Figure 2:
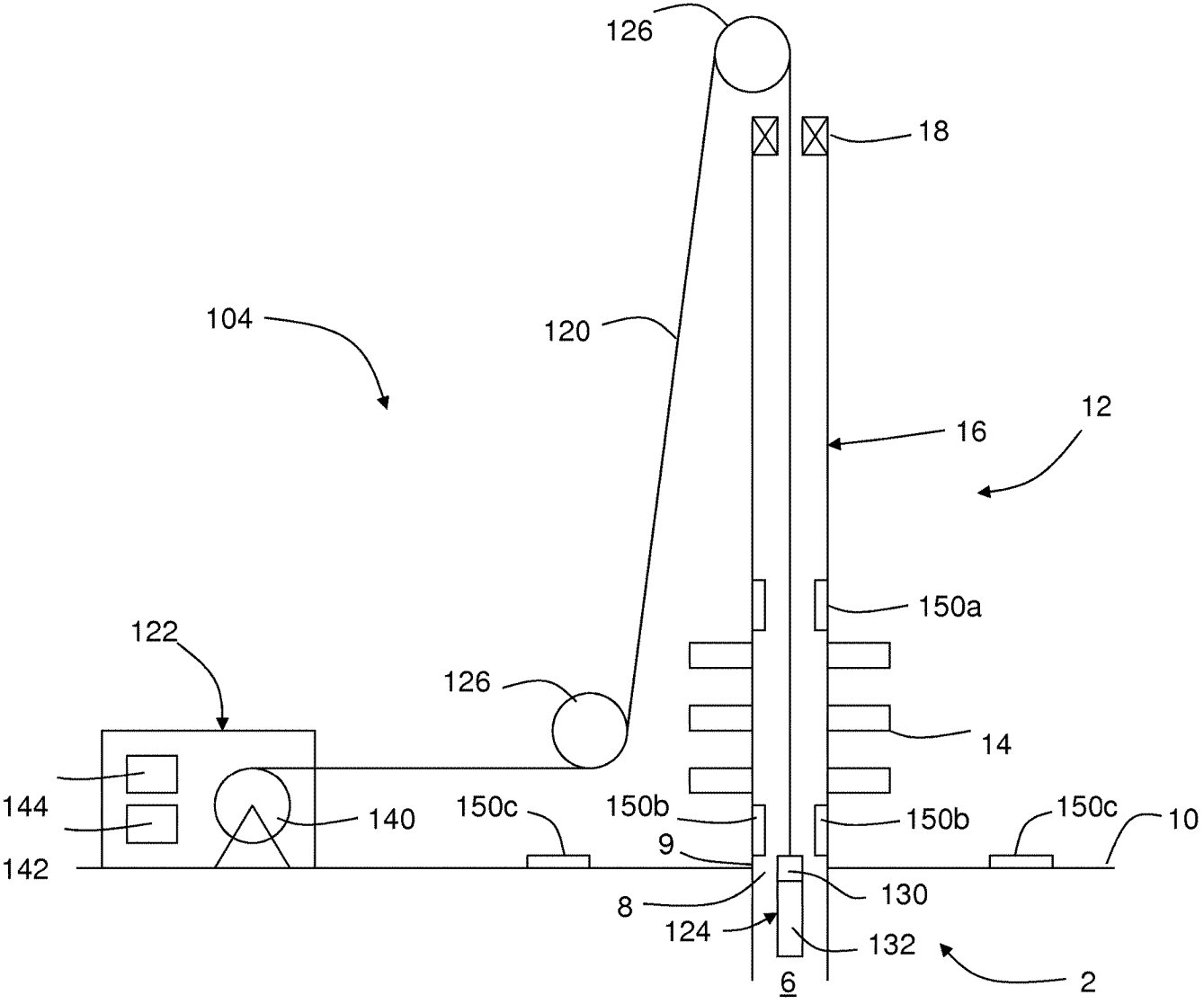
FIG. 2 is a schematic of an oil or gas well and a second system for performing operations in the well.

FIG. 2 shows the oil or gas well 2 and a second system 104 for performing operations in the well 2. The second system 104 of FIG. 2 shares many like features with the first system 4 of FIG. 1 with like features being defined in FIG. 2 with the same reference numerals as the like features of FIG. 1 incremented by '100'.

Like the first system 4 of FIG. 1, the second system 104 of FIG. 2 comprises a line in the form of a composite slickline 120, a slickline unit 122 at one end of the slickline 120 and a downhole tool 124 attached to the other end of the slickline 120. The system 104 further comprises sheaves 126. The slickline 120 runs from the slickline unit 122 around the sheaves 126 and through the stuffing box 18 so that the tool 124 is suspended within the lubricator 16.

The tool 124 comprises a rope socket 130 for attaching the tool 124 to the slickline 120 and a tool sub 132 comprising a neutron pulse source for performing measurements of a subterranean formation surrounding the wellbore 6.

The slickline unit 122 comprises a winch 140 for paying out and/or hauling in the slickline 120, a controller 142 and a user interface 144 configured to permit an operator to manually control well operations and/or configured to convey information relating to the well operations to an operator.

The composite slickline 120 comprises at least one electrical conductor surrounded by at least one electrically insulating layer. The composite slickline 120 is electrically, magnetically and/or electromagnetically coupled with the controller 142 and the tool sub 132. The controller 142 and the tool sub 132 are configured for communication therebetween using an electrical or an electromagnetic signal transmitted along the slickline 120.

Unlike the first system 4 of FIG. 1, the second system 104 comprises multiple sensors for sensing a condition associated with the tool 124. For example, the system 104 of FIG. 2 comprises multiple neutron pulse sensors for detecting neutron pulses emitted by the tool sub 132. More specifically, the system 104 of FIG. 2 comprises a first neutron pulse sensor 150*a* within the lubricator 16 above the BOP 14, a second neutron pulse sensor 150*b* on a lower riser section 9 below the BOP 14, and one or more additional neutron pulse sensors 150*b* arranged on the surface 10 adjacent to the wellhead arrangement 12. The neutron pulse sensors 150*a*, 150*b*, 150*c* are configured for communication with the controller 142.

In use, the winch 140 pays out the slickline 120 so as to deploy the tool 124 from the lubricator 16 through the BOP 14 into the wellbore 6. The tool sub 132 performs measurements of the subterranean formation surrounding the wellbore 6 as the tool 124 moves along the wellbore 6. Logging data measured by the tool sub 132 may be stored in a memory of the tool sub 132 and/or may be transmitted to the controller 142 via the slickline 120.

When well logging operations are complete, the winch 140 hauls in the slickline 120 so as to recover the tool 124 from the wellbore 6 through the BOP 14 into the lubricator 16 under the control of the controller 142. In response to one or more of the neutron pulse sensors 150*a*, 150*b*, 150*c* detecting a neutron pulse, the controller 142 automatically controls the winch 140 so as to perform a safety procedure. More specifically, on detection by one or more of the neutron pulse sensors 150*a*, 150*b*, 150*c* of a neutron pulse, the controller 142 reverses the direction of rotation of the winch 140 so as to pay out the slickline 120 again until the tool 124 reaches a predetermined safe depth within the wellbore 6 which is selected to reduce neutron pulse emissions above the surface 10 to a safe level.

Additionally or alternatively, on detection by one or more of the neutron pulse sensors 150*a*, 150*b*, 150*c* of a neutron pulse, the controller 142 transmits an electrical and/or electromagnetic signal to the tool sub 132 via the slickline 120 causing the tool sub 132 to cease emitting neutron pulses.

Additionally or alternatively, on detection of a neutron pulse by one or more of the neutron pulse sensors 150*a*, 150*b*, 150*c*, the controller 142 communicates with the user interface 144 causing the user interface 144 to provide, raise or issue an alarm for the attention of an operator using vibration, sound and/or a visual signal.

By virtue of its position below the BOP, the neutron pulse sensor 150*b* may detect a neutron pulse before the neutron pulse sensor 150*a* allowing one or more safety procedures to be performed earlier as the tool 124 approaches the BOP 14. The neutron pulse radiation emitted by the tool sub 132 may travel a sufficient distance through the ground in a direction away from the tool sub 132 such that the location and arrangement of the neutron pulse sensors 150*c* may allow one or more safety procedures to be performed earlier or more reliably as the tool 124 is recovered from the wellbore 6 through the BOP 14 into the lubricator 16. The presence of the additional neutron pulse sensors 150*b*, 150*c* may also provide some redundancy in the event that the neutron pulse sensor 150*a* fails or provides an inaccurate reading.

Figure 3:
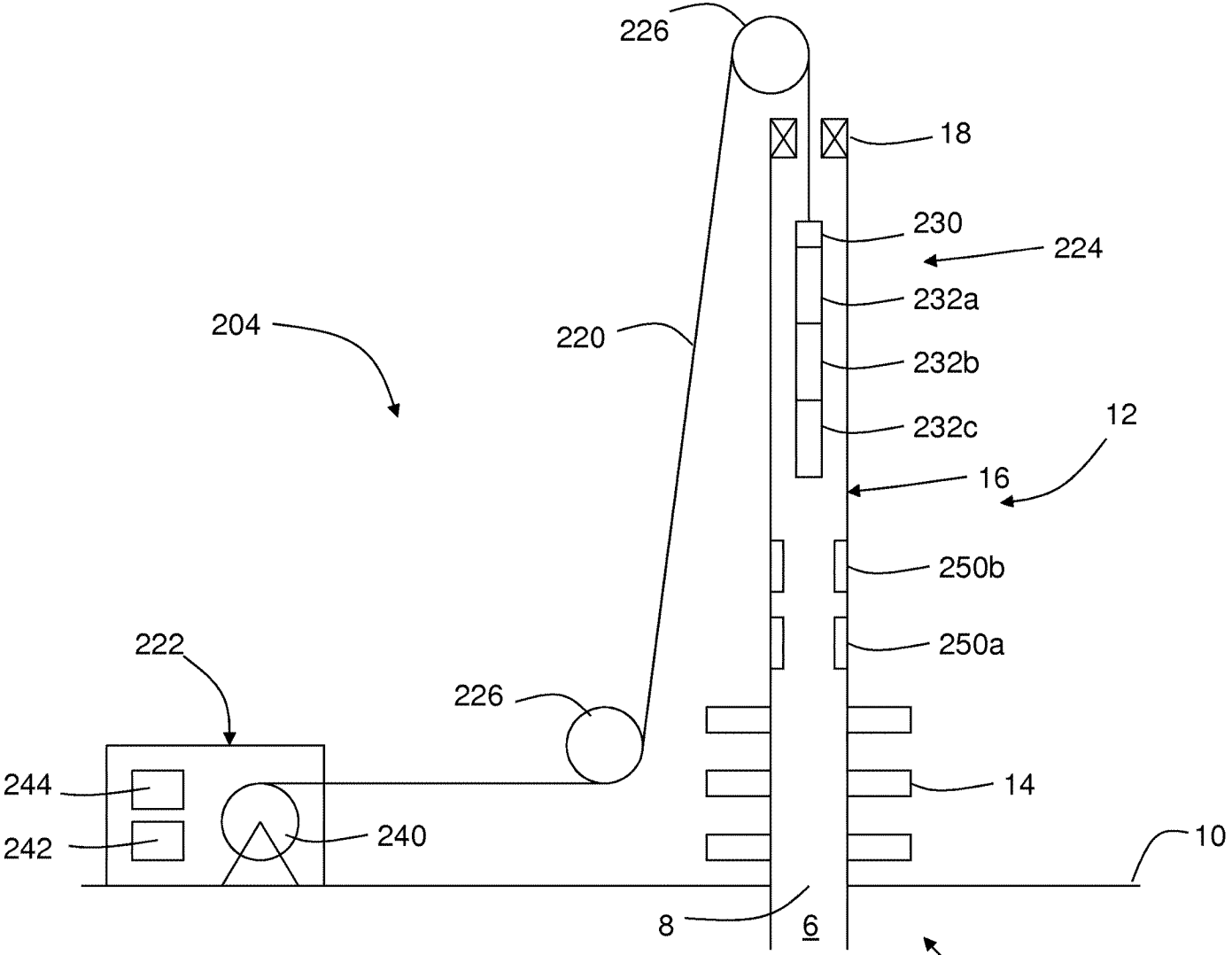
FIG. 3 is a schematic of an oil or gas well and a third system for performing operations in the well.

FIG. 3 shows the oil or gas well 2 and a third system 204 for performing operations in the well 2. The third system 204 of FIG. 3 shares many like features with the first system 4 of FIG. 1 with like features being defined in FIG. 3 with the same reference numerals as the like features of FIG. 1 incremented by '200'.

Like the first system 4 of FIG. 1, the third system 204 of FIG. 3 comprises a line in the form of a composite slickline 220, a slickline unit 222 at one end of the slickline 220 and a downhole tool 224 attached to the other end of the slickline 220. The system 204 further comprises sheaves 226. The slickline 220 runs from the slickline unit 222 around the sheaves 226 and through the stuffing box 18 so that the tool 224 is suspended within the lubricator 16.

The tool 224 comprises a rope socket 230 for attaching the tool 224 to the slickline 220 and first, second and third tool subs 232*a*, 232*b*, 232*c* for performing different functions.

One or more of the tool subs 232*a*, 232*b*, 232*c* may be configured to perform measurements of a subterranean formation surrounding the wellbore 6. For example, one or more of the tool subs 232*a*, 232*b*, 232*c* may comprise a pulsed neutron source or a gamma ray source for performing measurements of a subterranean formation surrounding the wellbore 6.

One or more of the tool subs 232*a*, 232*b*, 232*c* may be configured to perform a measurement of an environment within the wellbore 6. For example, one or more of the tool subs 232*a*, 232*b*, 232*c* may be configured to sense temperature and/or pressure within the wellbore 6. One or more of the tool subs 232*a*, 232*b*, 232*c* may be configured to sense or measure an electromagnetic field, an electric field and/or a magnetic field. One or more of the tool subs 232*a*, 232*b*, 232*c* may be configured to sense or measure an electromagnetic flux, an electric flux and/or a magnetic flux. One or more of the tool subs 232*a*, 232*b*, 232*c* may, for example, comprise an antenna for receiving an electromagnetic signal, an electrically conductive plate for detecting an electric field and/or a coil for detecting a magnetic field. One or more of the tool subs 232*a*, 232*b*, 232*c* may be configured to locate casing collars or may comprise a casing collar locator (CCL) device. One or more of the tool subs 232*a*, 232*b*, 232*c* may comprise a Hall effect sensor.

One or more of the tool subs 232*a*, 232*b*, 232*c* may comprise a weight bar and/or a centraliser.

Each of the tool subs 232*a*, 232*b*, 232*c* comprises a corresponding RFID tag which stores a unique tool sub identification code and a status of the tool sub.

The slickline unit 222 comprises a winch 240 for paying out and/or hauling in the slickline 220, a controller 242 and a user interface 244 configured to permit an operator to manually control well operations and/or configured to convey information relating to the well operations to an operator.

The composite slickline 220 comprises at least one electrical conductor surrounded by at least one electrically insulating layer. The composite slickline 220 is electrically, magnetically and/or electromagnetically coupled with the controller 242 and one or more of the tool subs 232*a*, 232*b*, 232*c*. The controller 242 and one or more of the tool subs 232*a*, 232*b*, 232*c* are configured for communication therebetween using an electrical or an electromagnetic signal transmitted along the slickline 220.

The system 204 comprises an RFID reader 250*a* located immediately above the BOP 14 within the lubricator 16 and a sensor 250*b* for detecting an emission, field and/or signal transmitted from one or more of the tool subs 232*a*, 232*b*, 232*c*. The RFID reader 250*a* and the sensor 250*b* are configured for communication with the controller 242.

In use, the winch 240 pays out the slickline 220 so as to deploy the tool 224 from the lubricator 16 through the BOP 14 into the wellbore 6. As the tool subs 232*a*, 232*b*, 232*c* move past the RFID reader 250*a* one-by-one, the RFID reader 250*a* reads the corresponding tool sub identification code and the tool sub status stored in the corresponding RFID tag and the controller 242 stores the tool sub identification code and the tool sub status in memory.

One or more of the tool subs 232*a*, 232*b*, 232*c* perform measurements as the tool 224 moves along the wellbore 6. Logging data measured by one or more of the tool subs 232*a*, 232*b*, 232*c* may be stored in the respective memories of the tool subs 232*a*, 232*b*, 232*c* and/or may be transmitted to the controller 242 via the slickline 220.

When well logging operations are complete, the winch 240 hauls in the slickline 220 so as to recover the tool 224 from the wellbore 6 through the BOP 14 into the lubricator 16 under the control of the controller 242. As each of the tool subs 232*a*, 232*b*, 232*c* moves past the RFID reader 250*a*, the RFID reader 250*a* reads the tool sub identification code and status and the controller 242 compares them to the stored tool sub identification code and status. Depending on the result of each comparison, the controller 242 controls the winch 240 and/or the relevant tool sub 232*a*, 232*b*, 232*c* so as to perform a safety procedure. For example, depending on the result of each comparison, the controller 242 may reverse the direction of rotation of the winch 240 so as to pay out the slickline 220 again until the tool 224 reaches a predetermined safe depth within the wellbore 6.

Additionally or alternatively, depending on the result of each comparison, the controller 242 may transmit an electrical and/or electromagnetic signal to the relevant tool sub 232*a*, 232*b*, 232*c* via the slickline 220 to disable or turn off the relevant tool sub 232*a*, 232*b*, 232*c*.

Additionally or alternatively, depending on the result of each comparison, the controller 242 may communicate with the user interface 244 causing the user interface 244 to provide, raise or issue an alarm for the attention of an operator using vibration, sound and/or a visual signal.

Additionally or alternatively, as each of the tool subs 232*a*, 232*b*, 232*c* moves past the RFID reader 250*a*, the RFID reader 250*a* may read sensor data measured by the tool sub 232*a*, 232*b*, 232*c* during well logging operations.

In response to the sensor 250*b* detecting an emission, field and/or signal generated or transmitted by one or more of the tool subs 232*a*, 232*b*, 232*c*, the controller 242 automatically controls the winch 240 so as to perform a safety procedure. More specifically, on detection of an emission, field and/or signal by the sensor 250*b*, the controller 242 reverses the direction of rotation of the winch 240 so as to pay out the slickline 220 again until the tool 224 reaches the predetermined safe depth within the wellbore 6.

Additionally or alternatively, on detection of an emission, field and/or signal by the sensor 250*b*, the controller 242 transmits an electrical and/or electromagnetic signal to the relevant tool sub 232*a*, 232*b*, 232*c* via the slickline 220 to disable or turn off the relevant tool sub 232*a*, 232*b*, 232*c* or to cause the relevant tool sub 232*a*, 232*b*, 232*c* to cease generating or transmitting the relevant emission, field and/or signal.

Additionally or alternatively, on detection of an emission, field and/or signal by the sensor 250*b*, the controller 242 may communicate with the user interface 244 causing the user interface 244 to provide, raise or issue an alarm for the attention of an operator using vibration, sound and/or a visual signal.

As a consequence of performing one or more such safety procedures, the probability of an operator being exposed to a harmful emission, field and/or signal may be reduced. As a consequence of performing one or more such safety procedures, the probability of a prohibited emission, field and/or signal being generated or transmitted in a safety zone surrounding the wellhead arrangement 12 may be reduced.

Figure 4:
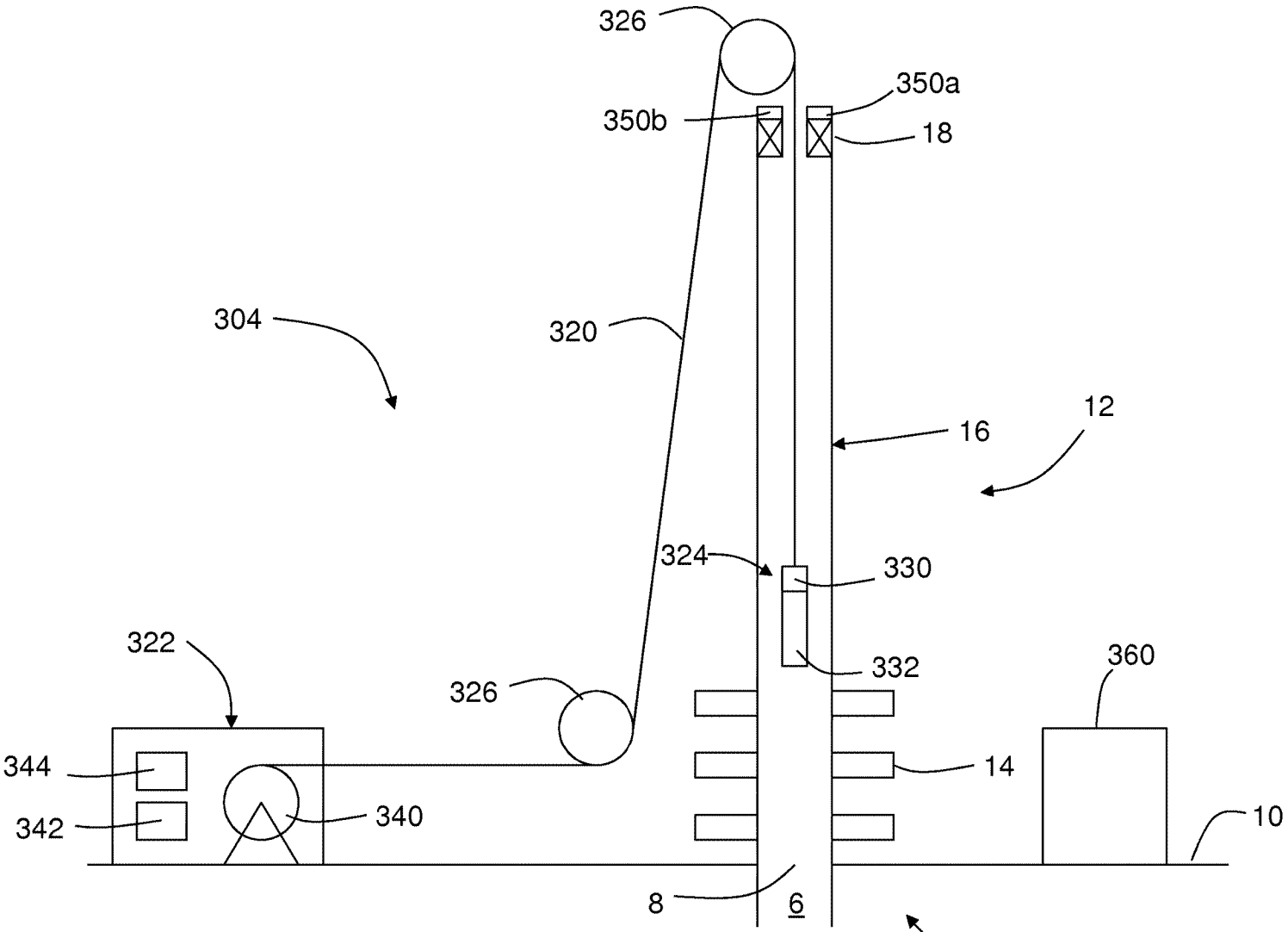
FIG. 4 is a schematic of an oil or gas well and a fourth system for performing operations in the well.

FIG. 4 shows the oil or gas well 2 and a fourth system 304 for performing operations in the well 2. The third system 304 of FIG. 4 shares many like features with the first system 4 of FIG. 1 with like features being defined in FIG. 4 with the same reference numerals as the like features of FIG. 1 incremented by '300'.

Like the first system 4 of FIG. 1, the fourth system 304 of FIG. 4 comprises a line in the form of a composite slickline 320, a slickline unit 322 at one end of the slickline 320 and a downhole tool 324 attached to the other end of the slickline 320. The system 304 further comprises sheaves 326. The slickline 320 runs from the slickline unit 322 around the sheaves 326 and through the stuffing box 18 so that the tool 324 is suspended within the lubricator 16.

The tool 324 comprises a rope socket 330 for attaching the tool 324 to the slickline 320 and a tool sub 332 for performing measurements of a subterranean formation surrounding the wellbore 6 and/or of an environment within the wellbore 6.

The slickline unit 322 comprises a winch 340 for paying out and/or hauling in the slickline 320, a controller 342 and a user interface 344 configured to permit an operator to manually control well operations and/or configured to convey information relating to the well operations to an operator.

The composite slickline 320 comprises at least one electrical conductor surrounded by at least one electrically insulating layer. The composite slickline 320 is electrically, magnetically and/or electromagnetically coupled with the controller 342 and the tool sub 332. The controller 342 and the tool sub 332 are configured for communication therebetween using an electrical or an electromagnetic signal transmitted along the slickline 320.

Unlike the first system 4 of FIG. 1, the fourth system 304 comprises a sensor for sensing a condition associated with the well 2 in the form of a gas sensor 350*a* for detecting the presence of, or measuring the concentration of, a gas such as a hydrocarbon gas, hydrogen sulphide ($H_2S$) and/or carbon dioxide ($CO_2$) at or adjacent to the stuffing box 18 indicative of leakage of such a gas from the stuffing box 18. In addition, the fourth system 304 comprises a further sensor for sensing a condition associated with the well 2 in the form of an acoustic sensor 350*b* for detecting vibrations associated with the escape of gas from the stuffing box 18 as a result of a seal fault or a seal failure at the stuffing box 18. The fourth system 304 also comprises Pressure Control Equipment (PCE) 360 for controlling stuffing box pressure.

The gas sensor 350*a*, the acoustic sensor 350*b*, the BOP 14 and the PCE 360 are configured for communication with the controller 342.

In use, the winch 340 pays out the slickline 320 so as to deploy the tool 324 from the lubricator 16 through the BOP 14 into the wellbore 6. The tool sub 332 performs measurements of the subterranean formation surrounding the wellbore 6 and/or of an environment within the wellbore 6 as the tool 324 moves along the wellbore 6. Logging data measured by the tool sub 332 may be stored in a memory of the tool sub 332 and/or may be transmitted to the controller 342 via the slickline 320.

When well logging operations are complete, the winch 340 hauls in the slickline 320 so as to recover the tool 324 from the wellbore 6 through the BOP 14 into the lubricator 16 under the control of the controller 342. In response to the gas sensor 350*a* detecting the presence of a gas or measuring a concentration of the gas in excess of a predetermined safe limit, the controller 342 automatically controls the PCE 360 to perform a safety procedure which comprises increasing the stuffing box pressure so as to prevent or at least reduce further leakage of the gas from the stuffing box 18.

Additionally or alternatively, in response to the acoustic sensor 350*b* detecting an acoustic signal of a sufficient magnitude, the controller 342 automatically controls the PCE 360 to increase the stuffing box pressure so as to prevent or at least reduce further leakage of gas from the stuffing box 18.

Additionally or alternatively, in response to the acoustic sensor 350*b* detecting an acoustic signal of a sufficient magnitude, the controller 342 may communicate with the user interface 344 causing the user interface 344 to provide, raise or issue an alarm for the attention of an operator using vibration, sound and/or a visual signal.

Additionally or alternatively, in response to the gas sensor 350*a* detecting the presence of a gas or measuring a concentration of the gas in excess of a predetermined safe limit, the controller 342 automatically controls the BOP 14 to perform a safety procedure which comprises sealing the wellbore 6.

Additionally or alternatively, in response to the acoustic sensor 350*b* detecting an acoustic signal of a sufficient magnitude, the controller 342 automatically controls the BOP 14 so as to seal the wellbore 6.

Additionally or alternatively, in response to the acoustic sensor 350*b* detecting an acoustic signal of a sufficient magnitude, the controller 342 may communicate with the user interface 344 causing the user interface 344 to provide, raise or issue an alarm for the attention of an operator using vibration, sound and/or a visual signal.

As a consequence of performing one or more such safety procedures, the probability of leakage of an explosive, flammable or noxious gas from the wellhead may be reduced.

One of ordinary skill in the art will understand that various modifications of the foregoing systems 4, 104, 204, 304 for performing operations in the well 2 are possible. For example, one or more of the tools 24, 124, 224, 324 may include a tool sub configured to generate a radioactive emission other than neutron pulses. One or more of the systems 4, 104, 204, 304 may include a sensor configured to detect a radioactive emission other than neutron pulses. One or more of the tools 24, 124, 224, 324 may include a tool sub configured to generate gamma rays or gamma radiation. One or more of the sensors 50, 150*a*, 150*b*, 250*b* may be configured to detect gamma rays or gamma radiation.

One or more of the tools 24, 124, 224, 324 may include a tool sub configured to generate an electromagnetic field. One or more of the systems 4, 104, 204, 304 may include a sensor configured to detect an electromagnetic field. One or more of the tools 24, 124, 224, 324 may include a tool sub configured to generate an electric field and/or a magnetic field. One or more of the systems 4, 104, 204, 304 may include a sensor configured to detect an electric field and/or a magnetic field. One or more of the tools 24, 124, 224, 324 may include a tool sub configured to generate an electromagnetic flux. One or more of the systems 4, 104, 204, 304 may include a sensor configured to detect an electromagnetic flux. One or more of the tools 24, 124, 224, 324 may include a tool sub configured to generate an electric flux and/or a magnetic flux. One or more of the systems 4, 104, 204, 304 may include a sensor configured to detect an electric flux and/or a magnetic flux.

One or more of the tools 24, 124, 224, 324 may include a tool sub configured to generate a RF electromagnetic field and/or a RF electromagnetic signal. One or more of the systems 4, 104, 204, 304 may include a sensor configured to detect a RF electromagnetic field and/or a RF electromagnetic signal.

One or more of the tools 24, 124, 224, 324 may include a tool sub configured to generate an optical field and/or an optical signal. One or more of the systems 4, 104, 204, 304 may include a sensor configured to detect an optical field and/or an optical signal.

One or more of the tools 24, 124, 224, 324 may include a tool sub configured to generate an acoustic signal. One or more of the systems 4, 104, 204, 304 may include a sensor configured to detect an acoustic signal.

One or more of the tools 24, 124, 224, 324 may include a tool sub configured to locate casing collars or may comprise a casing collar locator (CCL) device. One or more of the tools 24, 124, 224, 324 may include a tool sub comprising a Hall effect sensor.

One or more of the tools 24, 124, 224, 324 may include a tool sub comprising an active RFID tag or a passive RFID tag.

The BOP 14 may be configured for communication with the controller 42, 142, 242, 342. The controller 42, 142, 242, 342 may be configured to control the BOP 14 so as to perform a safety procedure on detection of a condition associated with the tool and/or the well. For example, the controller 42, 142, 242, 342 may be configured to control the BOP 14 so as to seal the well 2 on detection of an unsafe, abnormal or undesirable condition associated with the tool and/or the well. The controller 42, 142, 242, 342 may be configured to control the BOP 14 so as to shear the slickline 20, 120, 220, 320 or the tool 24, 124, 224, 324 on detection of an unsafe, abnormal or undesirable condition associated with the tool and/or the well.

Although tool 224 includes three tool subs 232*a*, 232*b*, 232*c*, tool 224 may include more or fewer than three tool subs. Similarly, although tools 24, 124 and 324 each include a single tool sub, each tool 24, 124 and 324 may include more than one tool sub.

One or more of the systems 4, 104, 204, 304 may comprise a sensor for sensing a temperature and/or a pressure of a fluid within the wellhead arrangement 12, for example within the lubricator 16. The controller 42, 142, 242, 342 may be configured to control at least one of the winch 40, 140, 240, 340, one or more tool subs, the BOP 14 and the PCE 360 to perform a safety procedure in response to the temperature and/or the pressure of the fluid sensed within the wellhead arrangement 12.

One or more of the systems 4, 104, 204, 304 may comprise a temperature sensor for sensing an exterior temperature of a tool. The temperature sensor may be located at, adjacent to, or within the wellhead arrangement 12. The controller 42, 142, 242, 342 may be configured to control at least one of the winch 40, 140, 240, 340, one or more tool subs, the BOP 14 and the PCE 360 to perform a safety procedure in response to the sensed exterior temperature of the tool when the tool is at, adjacent to, or within the wellhead arrangement 12. For example, the tool may include a perforating gun and the exterior temperature of the perforating gun may be indicative of the status of an explosive charge within the perforating gun. Specifically, if the exterior temperature of the perforating gun is higher than a predetermined threshold temperature, this may be indicative of an explosive charge within the perforating gun which has failed to detonate. The safety procedure may comprise arresting motion of the perforating gun and lowering the perforating gun to a safe depth to avoid the perforating gun being recovered within the wellhead arrangement with an undetonated explosive charge. The safety procedure may comprise communicating with and controlling the perforating gun to disable or cut power to a detonator of the perforating gun.

The tool may comprise a temperature sensor for sensing an interior temperature of the tool. The controller 42, 142, 242, 342 may be configured to control at least one of the winch 40, 140, 240, 340, one or more tool subs, the BOP 14 and the PCE 360 to perform a safety procedure in response to the sensed interior temperature of the tool when the tool is at, adjacent to, or within the wellhead arrangement 12. For example, the tool may include a perforating gun and the interior temperature of the perforating gun may be indicative of the status of an explosive charge within the perforating gun. Specifically, if the interior temperature of a perforating gun is higher than a predetermined threshold temperature, this may be indicative of an explosive charge within the perforating gun which has failed to detonate. The safety procedure may comprise arresting motion of the perforating gun and lowering the perforating gun to a safe depth to avoid the perforating gun being recovered within the wellhead arrangement with an undetonated explosive charge. The safety procedure may comprise communicating with and controlling the perforating gun to disable or cut power to a detonator of the perforating gun. Additionally or alternatively, the tool may include a battery such as a lithium battery and the interior temperature of the tool may be indicative of the status of the battery within the tool. Specifically, a raised interior temperature of the tool may be indicative of thermal run-away of the battery.

The tool may comprise a pressure sensor for sensing an interior pressure of the tool. The controller 42, 142, 242, 342 may be configured to control at least one of the winch 40, 140, 240, 340, one or more tool subs, the BOP 14 and the PCE 360 to perform a safety procedure in response to the sensed interior pressure of the tool when the tool is at, adjacent to, or within the wellhead arrangement 12. For example, the tool may include a perforating gun and the interior pressure of the perforating gun may be indicative of the status of an explosive charge within the perforating gun. Specifically, if the interior pressure of the perforating gun is higher than a predetermined threshold pressure, this may be indicative of an explosive charge within the perforating gun which has failed to detonate. The safety procedure may comprise arresting motion of the perforating gun and lowering the tool to a safe depth to avoid the perforating gun being recovered within the wellhead arrangement with an undetonated explosive charge. The safety procedure may comprise communicating with and controlling the perforating gun to disable or cut power to a detonator of the perforating gun.

One or more of the systems 4, 104, 204, 304 may include a proximity sensor configured to detect the proximity of a tool. The proximity sensor may be located at, adjacent to, or within, the wellhead arrangement 12. The controller 42, 142, 242, 342 may be configured to communicate with one or more further sensors in response to detection by the proximity sensor of the proximity of the tool. The controller 42, 142, 242, 342 may, for example, be configured to interrogate one or more further sensors in response to detection by the proximity sensor of the proximity of the tool.

What is claimed is:

1. A method for performing operations in a well, comprising:

sensing a condition at, adjacent, or within a wellhead arrangement located at an opening of the well when a tool is located at, adjacent to, or within the wellhead arrangement; and performing a safety procedure in response to the sensed condition to improve the safety of the well operations, wherein performing the safety procedure comprises:

transmitting a signal from a controller to the tool via a line attached to the tool to thereby communicate with the tool; and controlling the operation of the tool in response to the signal received by the tool via the line.

2. A method according to claim 1, comprising sensing the condition when at least one of:

during recovery of the tool from the well;

as the tool is recovered into the wellhead arrangement; and when the tool is located within the wellhead arrangement.

3. A method according to claim 1, wherein the sensed condition is associated with at least one of:

a status of the tool;

an emission, field or signal transmitted to and/or from the tool, extending to and/or from, and/or coupled from the tool;

radio-activity;

at least one of an electromagnetic field, an electric field, a magnetic field, an electromagnetic flux, an electric flux, a magnetic flux, a RF electromagnetic field, a RF electromagnetic signal, an optical field, an optical signal, and an acoustic signal;

an exterior temperature of the tool;

an interior temperature of the tool; and an interior pressure of the tool.

4. A method according to claim 1, wherein sensing the condition comprises reading or receiving information from the tool and wherein the information read or received from the tool comprises at least one of tool status information, tool identification information and tool sensor information.

5. A method according to claim 1, comprising sensing the proximity of the tool to the opening of the well.

6. A method according to claim 1, wherein performing the safety procedure comprises at least one of:

controlling the tool;

arresting movement of the tool; and lowering the tool to a predetermined position within the well.

7. A method according to claim 1, wherein performing the safety procedure comprises at least one of controlling a condition of the tool, controlling a status of the tool, switching off the tool, disabling the tool, isolating the tool, switching off or cutting an emission, field or signal transmitted to and/or from the tool, extending to and/or from the tool, and/or coupled to and/or from the tool.

8. A method according to claim 1, wherein performing the safety procedure comprises providing, raising or issuing an alarm.

9. A method according to claim 1, wherein performing the safety procedure comprises sealing the well.

10. A method according to claim 1, comprising providing the tool with an RFID tag and storing at least one of tool status information, tool identification information and tool sensor information in the RFID tag, and locating an RFID reader at, adjacent to, or within, the wellhead arrangement and using the RFID reader to read the information store in the RFID tag.

11. A method according to claim 1, wherein the sensed condition is associated with at least one of:

a composition and/or concentration of a fluid within the wellhead arrangement or of a fluid emitted from the wellhead arrangement;

a composition and/or a concentration of at least one of a fluid, a hydrocarbon fluid, a gas, a hydrocarbon gas, hydrogen sulphide and carbon dioxide; and a pressure and/or a temperature of a fluid at, adjacent or within the wellhead arrangement.

12. A method according to claim 1, wherein performing the safety procedure comprises controlling at least one of:

an environment at, adjacent or within the wellhead arrangement; and a stuffing box pressure so as to contain fluid in the wellhead arrangement or so as to at least reduce leakage of fluid from the wellhead arrangement.

13. A method according to claim 1, comprising:

providing the tool with an RFID tag;

storing tool information in the RFID tag; and using an RFID tag reader provided at, adjacent to, or within the wellhead arrangement at the opening of the well to read the stored tool information from the RFID tag when the tool is located at, adjacent to, or within the wellhead arrangement; and performing the safety procedure in response to the stored tool information read from the RFID tag.

14. A method according to claim 13, wherein the tool information comprises at least one of a tool identifier code, a tool status and tool sensor data.

15. A method according to claim 13, comprising at least one of:

reading the stored tool information from the RFID tag as the as the tool is recovered from the well past the RFID tag reader; and reading the stored tool information from the RFID tag as the tool is deployed into the well past the RFID tag reader.

16. A method according to claim 13, wherein performing the safety procedure comprises controlling at least one of:

a position or status of the tool; and controlling an environment at, adjacent to, or within the wellhead arrangement.

17. A method according to claim 13, comprising:

providing each tool of a plurality of tools with an RFID tag;

storing tool information in each RFID tag; and using an RFID tag reader provided at, adjacent to, or within a wellhead arrangement at an opening of a well to read the stored tool information from each RFID tag.

18. A method according to claim 17, comprising performing the safety procedure in response to the stored tool information read from one or more of the RFID tags.

19. A method according to claim 1, wherein performing the safety procedure comprises paying out and/or hauling in the line so as to control the position of the tool in the well.

20. A method according to claim 1, wherein performing the safety procedure comprises moving the tool through one or more predetermined movements.

21. A method according to claim 1, wherein the line comprises at least one of a composite slickline, a coated slickline, and an insulated slickline.

22. A system for performing operations in a well, wherein the well comprises a wellhead arrangement located at an opening of the well and the system comprises:

a tool;

a line attached to the tool;

a sensor for sensing a condition at, adjacent, or within the wellhead arrangement when the tool is located at, adjacent to, or within the wellhead arrangement; and a controller configured for communication with the sensor and the well equipment, wherein the controller is configured to perform a safety procedure in response to the sensed condition to improve the safety of the well operations, and wherein performing the safety procedure comprises:

transmitting a signal from the controller to the tool via the line to thereby communicate with the tool; and controlling the operation of the tool in response to the signal received by the tool via the line.

* * * * *